United States Patent [19]

Krapfenbauer

[11] 4,307,592

[45] Dec. 29, 1981

[54] COLD ROLLING METHOD AND COLD ROLLING APPARATUS

[75] Inventor: Hans Krapfenbauer, Zürich, Switzerland

[73] Assignee: Firma Ernst Grob, Männedorf, Switzerland

[21] Appl. No.: 69,391

[22] Filed: Aug. 24, 1979

[30] Foreign Application Priority Data

Sep. 8, 1978 [CH] Switzerland ..... 9466/78

[51] Int. Cl.³ ..... B21H 5/02

[52] U.S. Cl. ..... 72/95; 72/191

[58] Field of Search ..... 72/95, 100, 191

[56] References Cited

U.S. PATENT DOCUMENTS 2,991,672 7/1961 Meyer et al. ..... 72/100

FOREIGN PATENT DOCUMENTS 207315 8/1956 Australia ..... 72/191

*Primary Examiner*—Lowell A. Larson

*Attorney, Agent, or Firm*—Werner W. Kleeman

[57] ABSTRACT

A cold rolling method wherein the workpiece is advanced along its lengthwise axis and rotated in pulsating fashion, in accordance with a sinusoidal-like rotational speed-time diagram, while its surface is machined during briefly effective individual rolling or generating operations by means of generating rolls seated in roller or rolling heads. Each rolling operation is accomplished when the rotational speed of the workpiece is at the lower reversal region of the aforementioned diagram. The cold rolling machine comprises a worm gear for rotating the workpiece together with its clamping or chucking device, the worm gear being seated upon the chucking device. The related worm is mounted in a displaceable carriage. This carriage is moved to-and-fro by an eccentric drive or equivalent structure, and the action of the worm is superimposed upon the worm gear and there is formed the sinusoidal-like course of the rotational speed as a function of time.

7 Claims, 4 Drawing Figures

V

P
P'
W
t

V

K
I
t

COLD ROLLING METHOD AND COLD ROLLING APPARATUS

BACKGROUND OF THE INVENTION

The present invention relates to a new and improved cold rolling method and cold rolling apparatus for the performance of such method.

Generally speaking, the cold rolling method is employed for fabricating, by cold working, a workpiece having straight or helical profile. The workpiece is displaced along its lengthwise axis and discontinuously rotated thereabout and externally machined by substantially ring-shaped profiled generating rolls. By means of each generating roll there is accomplished in the same and predominantly in the directional sense extending in the lengthwise direction of the profile individual generating or rolling operations which are briefly effective in rapid sequence and accommodated to the profile division and the movement of the workpiece. Thus, with the same generating roll individual rolling operations, carried out in succession, can be serially performed at a screw-line shaped region or zone of the workpiece surface which is governed by the workpiece movement, and there are performed in the profile lengthwise direction successive individual rolling operations which, as concerns their effect at the workpiece, overlap.

Generally speaking, the cold rolling machine for performance of the method is of the type comprising at least one revolvingly driven generating or rolling head in which there is rotatably mounted at least one generating roll and, further, possesses synchronized drives for the generating or rolling heads and the workpiece.

A similar method and cold rolling machine, employing continuous or intermittent rotational drive of the workpiece, is disclosed in German Pat. No. 1,016,222. With the continuous drive mode of operation, the workpiece also rotates during such time as the generating rolls are in engagement therewith. With the intermittent drive mode of operation, the rotational movement of the workpiece is stopped during such time as the generating rolls are in engagement with the workpiece.

The continuous drive mode affords the advantage that there are possible large angular velocities, because there do not occur any mass acceleration forces. Furthermore, an advantageous aspect thereof is the possibility of being able to change the number of teeth to be formed at the workpiece by simply changing change gears. What is however disadvantageous is the accuracy which can be attained with this operation, frequently not always adequate, because there occurs an undesired generating movement between the workpiece and the generating roll.

With the intermittent drive mode, by means of a Maltese cross-like mechanism, there is available the advantage that, owing to the standstill of the workpiece during such time as the generating rolls are effective thereat, there can be realized extremely great machining accuracy. On the other hand, what is however disadvantageous is that high mass acceleration forces prevail due to the unfavorable course of the velocity, and therefore, there are only possible low velocities. Additionally, the extreme accuracy can only be obtained if there is employed, for each tooth number, a specially designed Maltese-cross-like partial plate, which, however, is expensive and the exchange of which is time-consuming.

SUMMARY OF THE INVENTION

Therefore, with the foregoing in mind it is a primary object of the present invention to provide a new and improved cold rolling method and cold rolling apparatus which is not afflicted with the aforementioned drawbacks and limitations of the prior art construction discussed above.

Another and more specific object of the present invention aims at avoiding as extensively as possible the drawbacks of the continuous drive mode and the intermittent drive mode, i.e., obtaining high accuracy at high operating speed, and rendering possible simple switching from one tooth number to another tooth number of a workpiece, typically a gear, to be machined.

Yet a further significant object of the present invention aims at the provision of a new and improved construction of cold rolling apparatus and a method for operating the same, affording high accuracy at the machined workpiece, reliable operation, combining the advantages of the prior employed continuous drive mode and intermittent drive mode, while eliminating to a large extent the drawbacks thereof.

Yet a further important object of the present invention is to devise a new and improved construction of cold rolling apparatus which is relatively simple in design, extremely economical to manufacture, highly reliable in operation, not readily subject to breakdown or malfunction, and requires a minimum of servicing and maintenance.

Now in order to implement these and still further objects of the invention, which will become more readily apparent as the description proceeds, the inventive cold rolling apparatus contemplates rotating the workpiece such that its rotational speed-time diagram assumes a sinusoidal configuration and each individual rolling or generating operation is accomplished at the region of a lower reversal arc or turning region of such diagram.

As explained above, the invention is not only concerned with the aforementioned method aspects, but also relates to cold rolling apparatus for the performance of such method. The cold rolling apparatus or machine of the present development is manifested by the features that at the workpiece drive there is provided a multi-element drive or power transmission arrangement containing a force-transmitting element upon whose rotational movement there is superimposed an oscillating movement.

The rotational movement of the workpiece is designed to be pulsating, so that, during the engagement of a generating roll at the workpiece, it only carries out a very slow and slight rotational movement, which, in fact, can even be reduced to standstill. This appreciably increases the machining accuracy. On the other hand, owing to the sinusoidal course of the rotational speed-time diagram the mass acceleration forces which arise are less severe, so that it is possible to perform the machining work at relatively high speeds. Finally, with this drive mode it is possible, by replacing change gears or using electronic rotational speed controls to convert in a simple and rapid manner from the machining of one type of gear to another. To this end, there need only be changed the eccentricity of the eccentric member, something likewise easy and inexpensive to accomplish.

Advantageously, the invention contemplates using for the drive a worm gearing drive, the worm of which is rotatably mounted in a carriage and is rotatably driven. This carriage itself can be moved to-and-fro by a suitable eccentric or eccentric member along the worm axis. Due to this carriage motion the drive effect of the worm upon the worm gear, depending upon the direction of movement and displacement speed of the carriage, is different. During displacement of the carriage opposite to the rotational sense of the worm gear, it is possible to markedly reduce or even temporarily completely eliminate the drive action of the worm, whereas during the return movement of the carriage in the other direction the worm gear can be additionally accelerated.

As the eccentric member there can be used, by way of example, both a disk and also a crank and control of the displacement stroke can be easily accomplished by simply exchanging the eccentric member for another or by adjusting the crank pin.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic perspective view of a cold rolling machine constructed according to the invention disclosing the movable parts thereof and omitting the frame structure as matter of convenience in illustration;

FIG. 2 is a schematic top plan view of the eccentric member or eccentric and the coacting carriage or the like;

DETAILED DESCRIPTION OF THE PREFERRED EMBODIMENTS

Figures 1, 2:
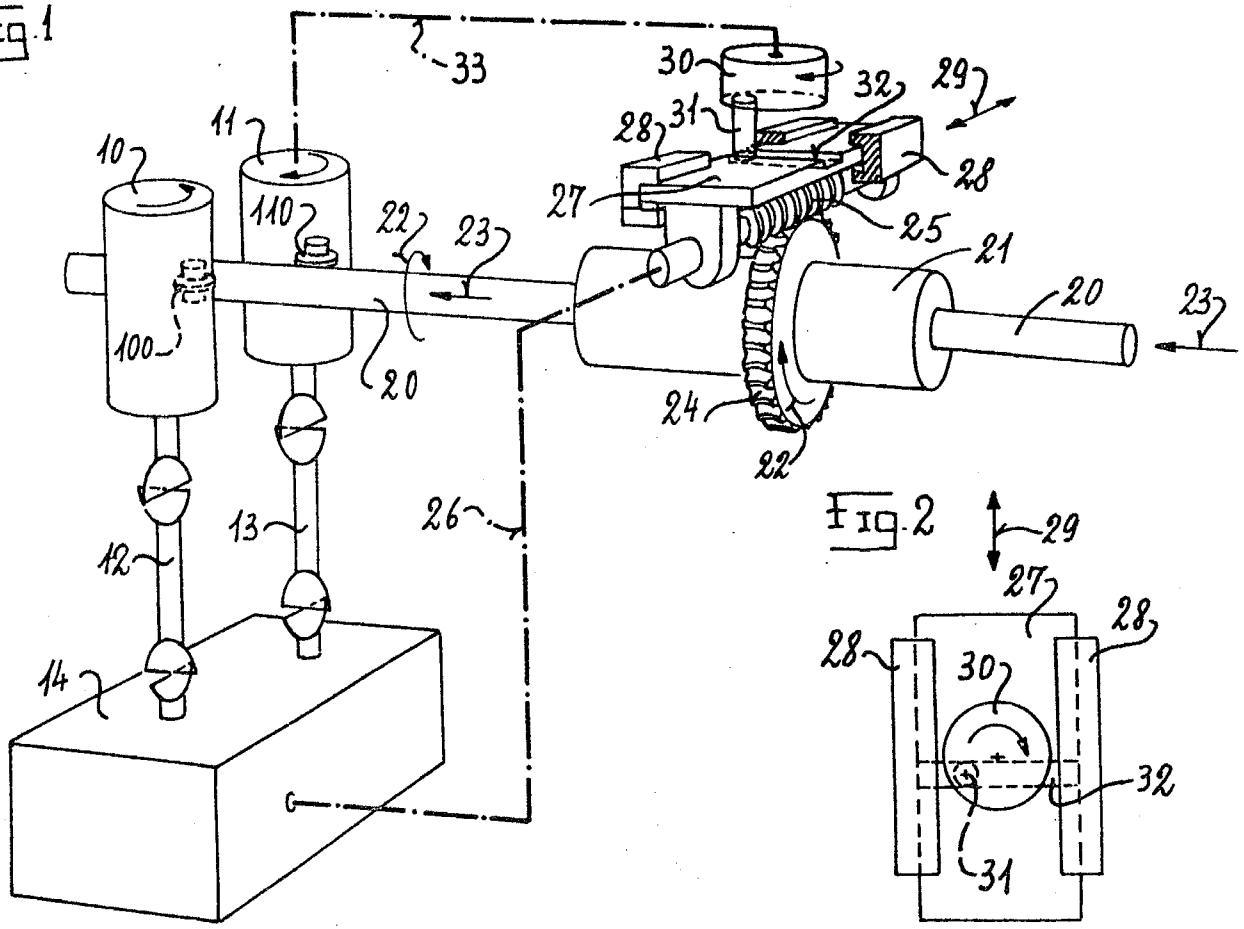

Describing now the drawings, it is to be understood that only enough of the cold rolling machine or apparatus of the present development has been shown in the drawings, as a matter of convenience in illustration, to enable those skilled in the art to readily understand the underlying principles and concepts of the present development. Turning attention therefore to the exemplary embodiment of cold rolling machine shown in FIGS. 1 and 2 it will be seen that in a not particularly illustrated but standard machine frame there are mounted two generating or rolling heads 10 and 11. In each such generating head 10 and 11 there is rotatably mounted, as is well known in this art, a related generating roll 100 and 110, respectively. The generating heads 10 and 11 can be synchronously driven with the same rotational speed, but in opposite rotational sense, by a motor-gearing unit, shown in the form of a drive block or assembly 14, through the agency of the universal shafts 12 and 13, respectively, such that the generating rolls 100 and 110 simultaneously engage at the workpiece 20. The generating heads 10 and 11 can be advanced towards the workpiece 20 in order to set the penetration or engagement depth of the generating rolls 100 and 110.

Workpiece 20 is held at a chucking or clamping device 21. This conventional chucking or clamping device 21 is rotatable, in the not illustrated frame, in the direction of the arrow 22 and is also mounted to be axially displaceable in the direction of the arrow 23. Both of these movements are accommodated to the generating head drive, in other words the drive unit or assembly 14.

Fixedly seated for rotation upon the chucking or clamping device 21 is a worm gear 24 which is driven by a worm 25. The worm gear 24 and the worm 25 constitute a worm gear drive arrangement or drive means. The drive of the worm 25, as generally indicated by the dash-dot lines 26, is accommodated to the drive unit or assembly 14 such that the workpiece 20 is rotated in accordance with the profile division. For instance, this can be accomplished in a number of different ways, for example mechanically, for instance with change gearing, or electrically, for instance by means of a synchronous motor or an asynchronous or slippering motor and tachogenerator or angle stepping transmitter.

The worm 25 is mounted in a carriage or slide 27 or equivalent structure. This carriage 27 can be displaced by an eccentric member or eccentric 30 or, as previously explained, equally by any other suitable or equivalent structure, such as a crank arrangement, in guide means 28 in the direction of the double-headed arrow 29. The guide means 28 and the not particularly shown bearing means of the eccentric member 30 are displaceably interconnected, by any suitable means, such as a connection element or bracket, with the chucking or clamping device 21 for movement in the direction of the arrow 23.

To simplify the illustration of the drawing the eccentric member 30 has been shown having a pin 31 of exaggerated length and without the follower or sliding block which rides in the groove 32 of the carriage 27. The extended pin 31 of the eccentric member 30 is shown engaging with the groove or slot 32 of the carriage 27.

The eccentric member 30 rotates at the same rotational speed as the generating heads 10 and 11. The dash-dot connection line 33 symbolizes the synchronization prevailing between rolling or generating heads 10 and 11 and the eccentric member 30. Usually the eccentric member 30 rotates at the rotational speed of the generating heads 10 and 11 multiplied by the number of generating rolls 100 and 110 per generating head 10 and 11, respectively, which in the embodiment under discussion amounts to one generating roll for each generating head.

The stroke or displacement path of the carriage 27 is designed such that the eccentricity e of the eccentric member 30 satisfies the equation $e=(d/2z)$, wherein the symbol d represents the pitch circle diameter of the worm gear 24 and the symbol z the number of teeth (profile rib number) of the workpiece 20.

If the machine should be converted from one number of teeth to another number of teeth, then, on the one hand, the rotational speed of the worm 25 and, on the other hand, the eccentricity of the eccentric member 30 are to be accommodated.

Accommodation of the rotational speed of the worm 25 can be mechanically accomplished by switching-over or replacing change gears, or electrically by the use of standard rotational speed adjustment devices.

Alteration of the eccentricity e of the eccentric member 30 can be easily and preferably undertaken by exchanging the eccentric member 30 of one eccentricity for another having a different eccentricity.

The illustrated cold rolling machine can operate in conventional fashion with continuous workpiece drive, as the same has been portrayed by the curve K in FIG.

Figure 3:
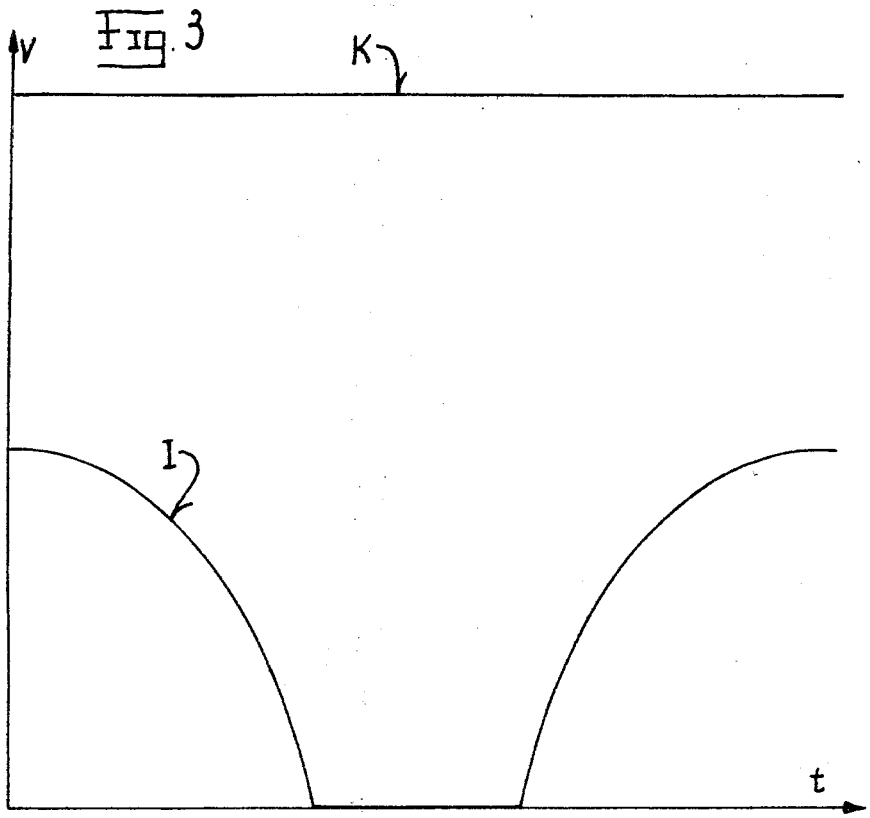
FIG. 3 is a rotational speed-time diagram portraying the prior art continuous and intermittent rotational drives.

3, when the eccentric member 30 is not driven. This however, as explained at the outset of this disclosure, is associated with the aforementioned drawbacks, but renders possible an appreciably higher operating speed than is possible when resorting to the use of the known intermittent drive mode, represented by the curve I in FIG. 3.

Figure 4:
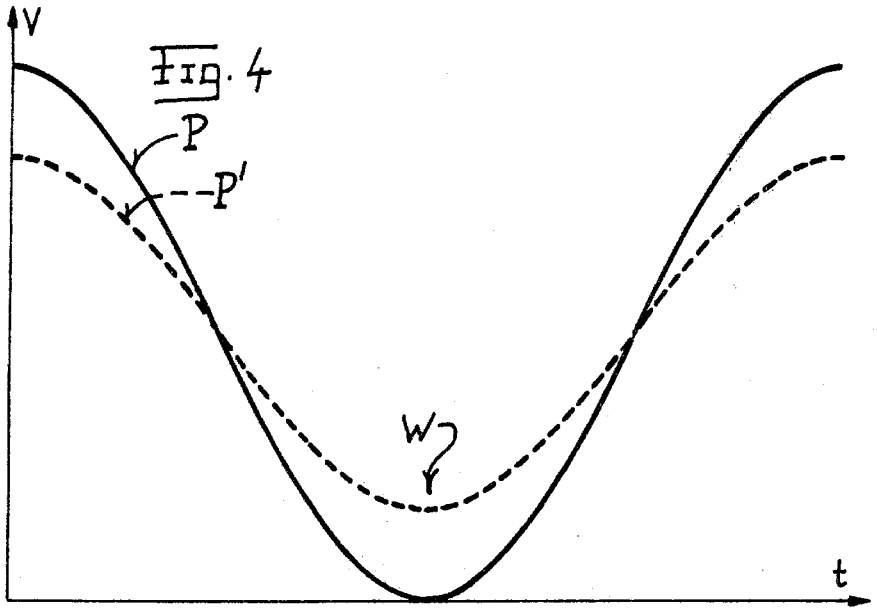
FIG. 4 are two rotational speed-time diagrams of a cold rolling apparatus or machine constructed to work in accordance with the teachings of the invention.

If the machine is operated, in accordance with the inventive method, with revolving eccentric or eccentric member 30, then the curve P of FIG. 4 is representative of the rotational speed of the workpiece 20, and the generating rolls 100 and 110 engage at the workpiece 20 at the lower reversal or turning region W of such curve P when the workpiece 20 is almost at standstill.

In many instances it is sufficient to provide a flatter course of the curve, as represented by the curve P' in FIG. 4, where the workpiece 20 never completely stops. Then it is possible to work with a lesser eccentricity e of the eccentric member 30 which satisfies the equation $e<(d/2z)$.

There is thus valid for the eccentricity e the equation $e\leqq(d/2z)$ wherein:

e represents the eccentricity of the eccentric member 30, d represents the pitch circle diameter of the worm gear 24, and z represents the number of teeth of the workpiece 20.

In this case there is possible a higher operating speed than if the workpiece were momentarily brought to a standstill condition.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of fabricating, by cold working, a workpiece having a straight or helical profile, comprising the steps of:

displacing a workpiece along its lengthwise axis and rotating said workpiece about such lengthwise axis;

machining the workpiece from the outside by means of substantially ring-like profiled generating rolls each supported in a related tool holder having a tool holder axis and which rotates during cold working, the generating rolls being moved by the tool holders so as to perform a planetary movement around the related tool holder axis which fails to intersect the axis of the workpiece;

the axis of rotation of each generating roll being substantially parallel to the lengthwise axis of its related tool holder;

intermittently placing the generating rolls into and totally out of contact with the workpiece during the machining step;

said machining step encompassing performing in the same directional sense which predominantly extends in the profile lengthwise direction individual generating operations, each time the generating rolls come into contact with the workpiece, which are briefly effective in rapid sequence and accommodated to the movement of the workpiece, so that with the same generating roll there are applied in succession successively performed individual generating operations each located at a screwline shaped zone of the workpiece surface which is governed by the movement of the workpiece;

performing in the profile lengthwise direction successive individual generating operations which overlap with respect to the application of the individual generating operations at the workpiece;

rotating the workpiece such that its rotational speed-time diagram follows an essentially sinusoidal-like course containing upper and lower reversal arcs;

accomplishing each individual generating operation at the region of a lower reversal arc of said rotational speed-time diagram; and the step of intermittently placing the generating rolls out of contact with the workpiece is accomplished as the speed of the workpiece moves towards the region of an upper reversal arc of said rotational speed-time diagram.

2. The method as defined in claim 1, further including the steps of:

stopping the rotational movement of the workpiece at the moment of maximum penetration of the relevant generating roll at the workpiece.

3. A cold rolling apparatus for cold working a workpiece comprising:

at least one revolvingly driven generating head which rotates during a generating movement around a lengthwise axis which fails to intersect the workpiece axis;

at least one generating roll rotatably mounted at said generating head and having a lengthwise axis;

said lengthwise axis of said generating head and said lengthwise axis of said generating roll being substantially in parallellism to one another;

synchronized drive means for said generating head and the workpiece;

said drive means acting upon said generating head in order to intermittently place the generating roll into and totally out of contact with said workpiece during cold working of said workpiece;

said drive means moving the workpiece through an essentially sinusoidal-like course containing upper and lower reversal arcs of its speed-time diagram;

said drive means including a multi-element power transmission means;

said drive means placing said generating roll totally out of contact with said workpiece as the speed of the workpiece moves from a lower reversal arc, where the generating roll is in contact with the workpiece, towards the region of an upper reversal arc of said rotational speed-time diagram; and said power transmission means incorporating a force-transmitting element having a rotational movement upon which is superimposed an oscillatory movement.

4. The cold rolling apparatus as defined in claim 3, wherein:

said power transmission means comprises:

a worm gear;

a worm driving said worm gear; and an eccentric member for oscillatingly moving said worm along its lengthwise axis.

5. The cold rolling apparatus as defined in claim 4, wherein:

said power transmission means further includes carriage means displaceable by said eccentric member; and said worm being mounted at said displaceable carriage means.

6. The cold rolling apparatus as defined in claim 5, wherein:

said carriage means is movable during each generating revolving motion through a full cycle.

7. The cold rolling apparatus as defined in claim 4, wherein:

said eccentric member has an eccentricity which is selectively in a range of less than to equal the pitch diameter of the worm gear divided by twice the number of teeth to be formed at the workpiece; and the rotational speed of said eccentric member is equal to the rotational speed of the generating head multiplied by the number of generating rolls.

* * * * *